US006289773B1

(12) United States Patent
Patry et al.

(10) Patent No.: US 6,289,773 B1
(45) Date of Patent: Sep. 18, 2001

(54) ADJUSTABLE WRENCH

(76) Inventors: Michael J. Patry, 825 Fox Tail Dr.; Michael W. Blasdel, 5001 Jessie James Dr., both of Edmond, OK (US) 73034

( * ) Notice: Subject to any disclaimer, the term of this patent is extended or adjusted under 35 U.S.C. 154(b) by 0 days.

(21) Appl. No.: 09/565,991

(22) Filed: May 6, 2000

(51) Int. Cl.[7] ..... B25B 13/58

(52) U.S. Cl. ..... 81/185; 7/138; 81/185.1; 81/185.2

(58) Field of Search ..... 81/185, 185.1, 81/185.2; 7/138

(56) References Cited

U.S. PATENT DOCUMENTS

| | | | | |
|---|---|---|---|---|
| 102,336 | | 4/1870 | Utley | 81/185 |
| 1,080,064 | | 12/1913 | Huber | 81/185 |
| 1,399,966 | | 12/1921 | King | 81/185 |
| 1,550,564 | | 8/1925 | Nagano | 81/185 |
| 1,646,140 | | 10/1927 | Dickie | 81/185 |
| 3,425,302 | * | 2/1969 | Davis . | |
| 4,237,756 | * | 12/1980 | Maclay . | |
| 4,324,160 | | 4/1982 | Maclay | 81/185 |
| 4,744,272 | | 5/1988 | Leatherman | 81/427.5 |
| 4,753,141 | | 6/1988 | Hamrick | 81/166 |
| 4,843,926 | * | 7/1989 | Bond . | |
| 5,062,173 | | 11/1991 | Collins | 7/118 |
| 5,920,935 | | 7/1999 | Beck | 7/128 |

OTHER PUBLICATIONS

Crescent® wrench, manuf. by Cooper Tools, 3535 Glenwood Ave, Raleigh, NC 27622.

Clench Wrench™, marked Patent Pending, sold by Sears, Roebuck & Co., 3333 Beverly Road, Hoffman Estates, IL 60179.

* cited by examiner

*Primary Examiner*—Timothy V. Eley
*Assistant Examiner*—Willie Berry, Jr.

(57) ABSTRACT

An improved adjustable wrench (10) having a body (12) that is divided into a handle portion (14) and a head portion (16). The head portion has an opening (20) defined by a first jaw member (22), a second jaw member (24), and a back portion (26). The first jaw member has a planar surface (32) that is spaced a predetermined distance from, and is parallel to and facing, a corresponding planar surface (34) on the second jaw member. A plurality of inch-increment shims (50) and a plurality of metric-increment shims (52) and an adapter shim (54), each having a hole (56) near one end, are pivotably coupled by a bolt (40) to the first and second jaw members. The bolt divides the opening into a shim-storage region (64) and a fastener-receiving region (62). The shims are selectively pivoted from the shim-storage region to the fastener-receiving region, thereby adapting the wrench for use on either inch or metric unit fasteners and also incrementally adjusting the width of the fastener-receiving region, enabling the wrench to be used on a wide range of fastener sizes while maintaining a minimum overall size and weight.

6 Claims, 3 Drawing Sheets

ADJUSTABLE WRENCH

BACKGROUND OF THE INVENTION

1. Field of the Invention

The present invention relates to adjustable wrenches used to manipulate fasteners such as nuts and bolts. Specifically, the present invention relates to an adjustable wrench having a fastener-receiving region into which shims are rotated to incrementally adjust the dimensions of the opening to accommodate a wide range of fastener sizes in two different measurement systems such as inch and metric units.

2. Description of the Prior Art

There are many times when people want to have a few basic hand tools with them so they can perform minor tasks quickly and conveniently. Common activities such as biking, camping, and fishing often require a person to make a simple repair or adjustment. Carrying a complete, multi-piece tool set with you at all times is not a practical option. Adjustable or multifunction tools are often the perfect compromise between utility, size and weight. For maximum utility, an adjustable wrench must be able to accommodate a wide range of fastener sizes and ideally be able to accommodate both inch and metric units.

Two types of wrenches have been proposed in the prior art in an attempt to meet this need: infinitely adjustable and incrementally adjustable.

A common example of an infinitely adjustable wrench is the Crescent® wrench, manufactured by Cooper Tools, 3535 Glenwood Ave., Raleigh, N.C. 27622. This design utilizes a fixed jaw and a movable jaw with teeth that engage a worm gear. Rotating the worm gear moves the movable jaw, allowing infinite adjustment in size. While this wrench has achieved widespread commercial acceptance, it has serious deficiencies in usage. The primary deficiency is the overall bulk of the head. This bulk is required to adequately support the movable jaw and the worm gear but it limits the use of the wrench in tight spaces. Another deficiency is the need to constantly adjust the wrench during use. This problem is the result of the loose tolerance in the fit of the worm gear to the movable jaw, which is required for the mechanism to work smoothly. To effectively use this tool, the user must place the jaws over the fastener, rotate the worm gear until the jaws are in firm contact, and then apply torque. Tight spaces can make this adjustment process difficult. The looseness also results in the degradation of the fit of the jaws to the fastener each time the wrench is removed from, and then re-applied to, the fastener. Therefore, the worm gear must be manipulated each time the wrench is removed and re-applied.

Efforts to address the aforementioned deficiencies in the crescent-type wrench have resulted in only minor improvement. For example, U.S. Pat. No. 4,753,141 to Hamrick (Jun. 28, 1988) utilizes a biasing spring that acts on the worm gear to press it against the teeth of the movable jaw. While this spring does reduce looseness, it does not eliminate the problem. The user must still periodically re-adjust the wrench during use.

Another example of an infinitely adjustable wrench is the Clench Wrench™, marked patent pending, sold by Sears, Roebuck and Co., 3333 Beverly Road, Hoffman Estates, Ill. 60179. This wrench relies on user applied torque on the handle to cause the jaws to grip the fastener with correspondingly increasing pressure. To use this wrench, the user must use a thumb or finger to open the jaws, place the wrench onto the fastener, allow the jaws to contact the fastener, and then reposition the hand onto the handle before torque can be applied. This action requires clearance that is not available in tight quarters. Another deficiency in this design is that the wrench must remain in the same plane as a nut for it to properly grip the flat sides of the nut. If, for example, the handle needs to be angled slightly to clear an obstacle, the jaws can easily slip off the nut. Still another problem with this design is that the grip on the fastener increases as torque is applied. The result is that the flat sides of a nut can be scarred as the jaws of this wrench dig into the material. This scarring not only causes cosmetic damage to the fastener but can also result in raised material on the flats that can interfere with subsequent use of other tools such as conventional wrenches or sockets.

Since nuts and bolts are produced in discrete sizes (such as 9/16, ½, 7/16-inch or 14, 13, 12-millimeters), an incremental approach to adjustment can also be used. Wrenches incorporating sliding or rotating shims for incremental adjustment have been proposed. Examples of this type of wrench include: U.S. Pat. No. 4,324,160 to Maclay (Apr. 13, 1982); U.S. Pat. No. 102,336 to Utley (Apr.26, 1870); U.S. Pat. No. 1,080,064 to Huber (Dec. 2, 1913); U.S. Pat. No. 1,399,966 to King (Dec. 13, 1921); U.S. Pat. No. 1,550,564 to Nagano (Aug. 18, 1925); and U.S. Pat. No. 1,646,140 to Dickie (Oct. 18, 1927). These wrenches can accommodate several sizes of fasteners. However, none of these prior art examples can accommodate both inch and metric unit fastener sizes in the same jaw opening. Following the teachings of the prior art, the only way to produce an incrementally adjusting wrench capable of handling both inch and metric unit fastener sizes would be to make it double-ended, with one end configured for inch unit fastener sizes and the other end configured for metric units.

From the above discussion, it can be seen that many efforts have been made in an attempt to produce an adjustable wrench that is:

- quickly and easily adjusted to fit a wide range of fastener sizes in both inch and metric units,
- a minimum overall size and weight,
- capable of maintaining a precise size setting during use, and
- simple, strong, and economical to manufacture.

Nowhere is the need for minimum size and maximum versatility more critical than in the case of the now common multifunction or combination tool. These tools, typified by U.S. Pat. No. 4,744,272 to Leatherman (May 17, 1988), generally take the form of a folding a a folding pair of pliers with several fold out implements such as knife blades, screwdrivers, files, saws, etc. stored in the handles (like the blades in a folding pocketknife). The result is a versatile tool that is convenient and compact. However, the only means provided to tighten a nut are pliers. Pliers, while useful, are not particularly well suited for this task since the user's grip strength determines the amount of torque that may be applied and they often cause damage to the fastener. Prior art adjustable wrenches have not been incorporated in these multifunction tools as fold out implements because of their bulk.

U.S. Pat. No. 5,920,935 to Beck (Jul. 13, 1999) shows a combination tool that incorporates an adjustable crescent-type wrench. However, since this wrench is an integral part of the handle and not a fold out implement, the overall size of the tool is increased, reducing its portability.

U.S. Pat, No. 5,062,173 to Collins (Nov. 5, 1991) shows a multifunction tool that incorporates a three-size, non-adjustable wrench as a fold out implement. This design, while maintaining the compactness desired in these combination tools, offers very limited functionality.

Clearly, there remains a need for a versatile, highly functional, adjustable wrench that is small enough to be incorporated as a foldout implement in a common multifunction tool.

OBJECTS AND ADVANTAGES

Accordingly, there remains a need for an adjustable wrench that combines simplicity of design, maximum functionality, and minimum overall size while avoiding the aforementioned disadvantages. The several objects and advantages of the present invention are:

- to provide an adjustable wrench that can accommodate a wide range of fastener sizes;
- to provide an adjustable wrench that can accommodate both metric and inch-sized fasteners in the same jaw opening;
- to provide an adjustable wrench that combines maximum utility with minimum overall size;
- to provide an adjustable wrench that once the proper size is selected, will not change in size during use; and
- to provide an adjustable wrench that utilizes a simple design to minimize costs of manufacture and assembly.

Still further objects and advantages of the present invention will become apparent from a consideration of the ensuing drawings and description.

Figure 1:
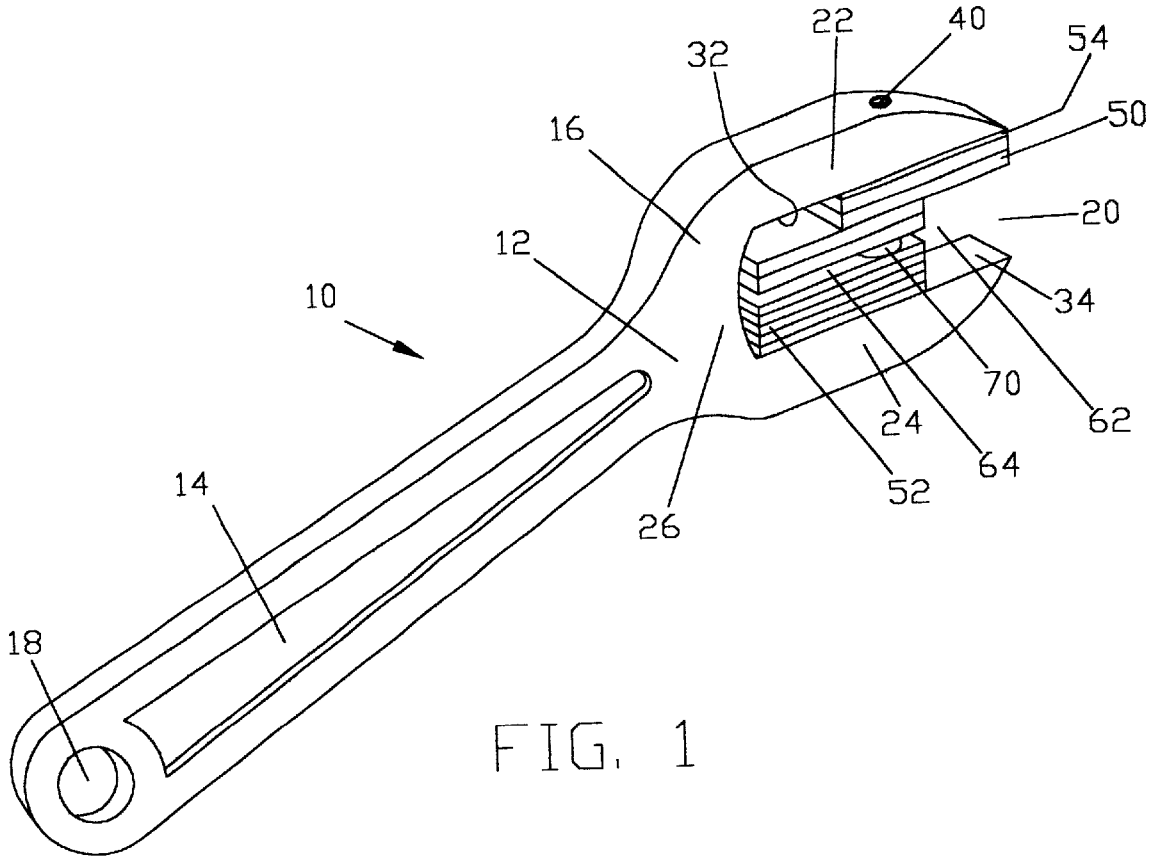
FIG. 1 is a perspective view showing a preferred embodiment of the present invention.

| REFERENCE NUMERALS IN DRAWINGS | |
|---|---|
| 10 | wrench |
| 12 | body |
| 14 | handle portion |
| 16 | head portion |
| 18 | aperture |
| 20 | opening |
| 22 | first jaw member |
| 24 | second jaw member |
| 26 | back portion |
| 32 | planar surface |
| 34 | planar surface |
| 40 | bolt |
| 42 | bolt head |
| 44 | hole |
| 46 | hole |
| 48 | recess |
| 50 | inch-increment shims |
| 52 | metric-increment shims |
| 54 | adapter shim |
| 56 | hole |
| 58 | edge |
| 60 | corner |
| 62 | fastener-receiving region |
| 64 | shim-storage region |
| 70 | spring washer |
| 90 | spring locking clip |
| 92 | bolt |
| 110 | wrench |
| 112 | body |
| 114 | hole |

-continued

| REFERENCE NUMERALS IN DRAWINGS | |
|---|---|
| 116 | handle of common multifunctional tool |
| 120 | common multifunctional tool |

DESCRIPTION OF THE PREFERRED EMBODIMENT

Referring now to the drawings, FIG. 1 shows a preferred embodiment of an adjustable wrench 10 made in accordance with the teachings of the present invention. As shown, wrench 10 includes an elongated body 12 that is divided into a handle portion 14 and a head portion 16. An aperture 18 is provided in the handle for hanging the wrench when not in use. Head portion 16 has a generally U-shaped opening 20 defined by a first jaw member 22, a second jaw member 24, and a back portion 26. First jaw member 22 has a planar surface 32 and second jaw member 24 has a corresponding planar surface 34. The planar surfaces face each other and are parallel to each other.

Figure 2:
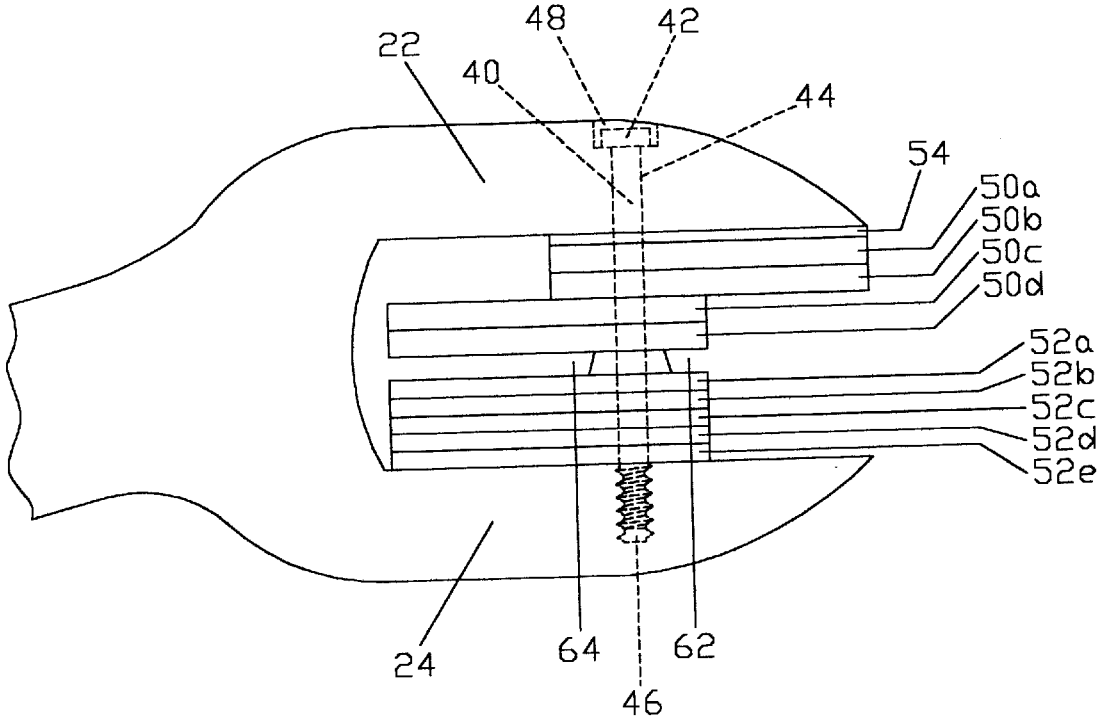
FIG. 2 is a detailed view of the head portion of the present invention.
Figure 3:
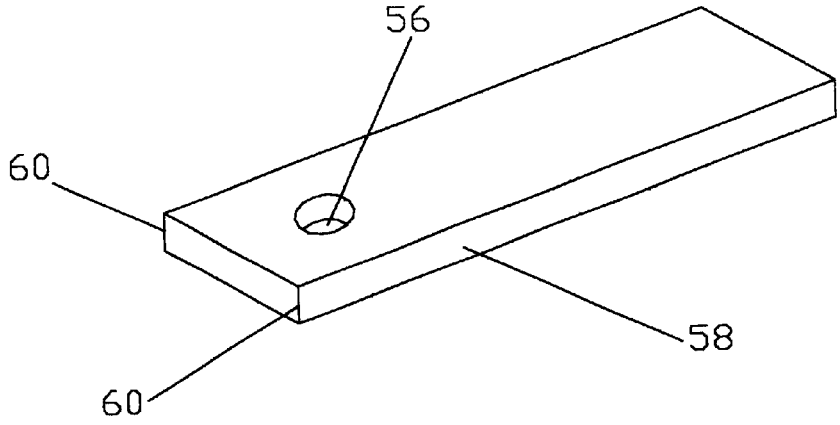
FIG. 3 is a perspective view of a typical shim.

Referring now to FIG. 2, there are four inch-increment shims 50*a*–50*d*, five metric-increment shims 52*a*–52*e*, and one adapter shim 54, for a total of ten shims. FIG. 3 shows the structural elements common to all of the shims. Each shim has a hole 56 near one end, an outer edge 58, and four corners 60.

The shims are rotatably coupled to the first and second jaw members by a bolt 40 having a head 42. Bolt 40 passes through a hole 44 in first jaw member 22 and is threadably received into a hole 46 in second jaw member 24. Bolt head 42 lies in a recess 48 in first jaw member 22 for a smooth outer profile. Bolt 40 divides opening 20 into a fastener-receiving region 62 and a shim-storage region 64. These two regions are approximately equal in size.

A spring washer 70 is located between inch-increment shim 50*d* and metric-increment shim 52*a*. The spring washer is preferably a common cone washer. The compressed spring washer exerts biasing force on the shims, urging the shims to remain in contact with each other and also with their corresponding planar surface. This biasing force also prevents the shims from freely spinning about bolt 40.

Figure 4:
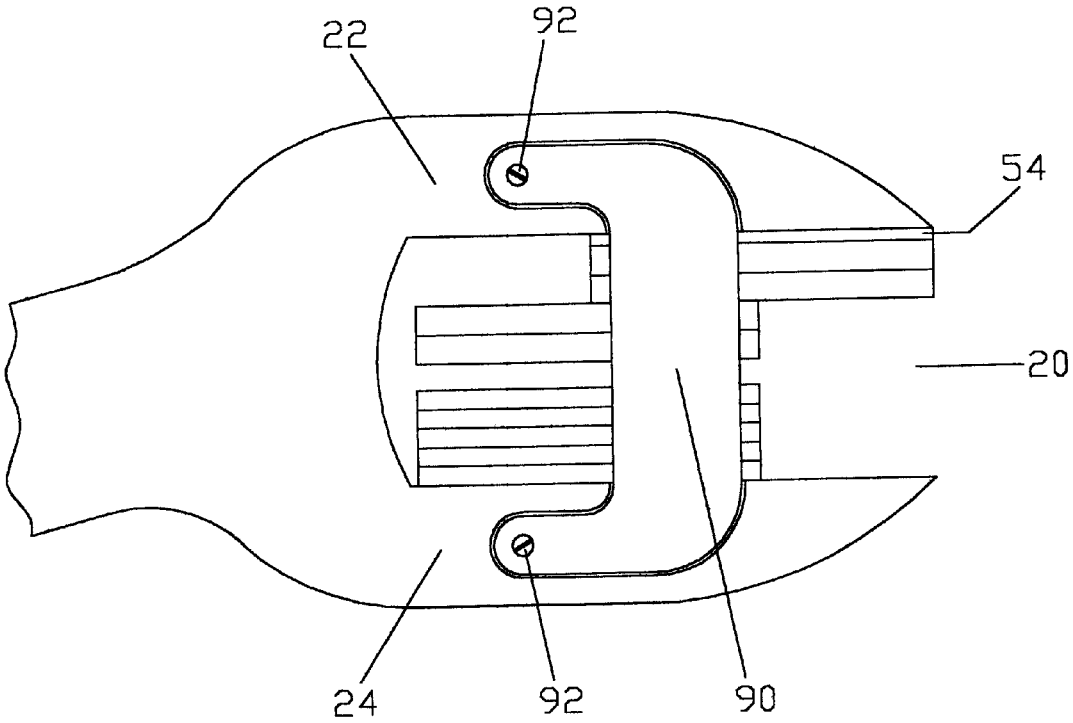
FIG. 4 is a detailed view of the head portion of an alternate embodiment further including a spring locking clip.

FIG. 4 shows an alternate embodiment that further includes a spring locking clip 90 that is attached to first jaw member 22 and to second jaw member 24 using two bolts 92. Spring locking clip 90 applies slight pressure to the edges 58 of the shims. When the shims are pivoted between the shim-storage region and the fastener-receiving region, corners 60, nearest hole 56, cause the spring locking clip to deflect outwardly and provide frictional resistance to prevent the shims from moving out of the user selected position.

Figure 5:
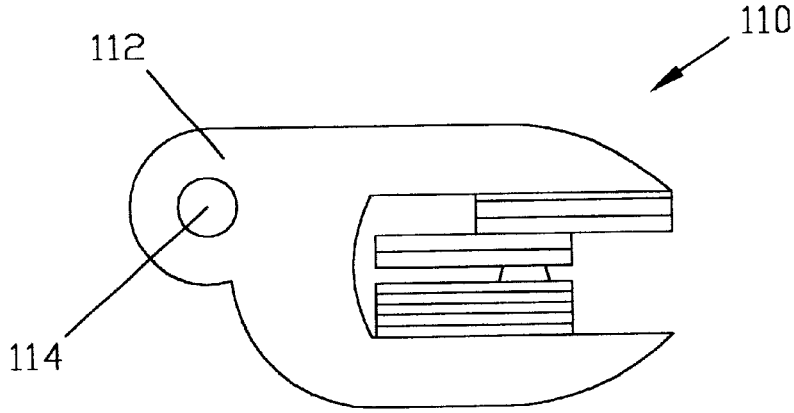
FIG. 5 is a plan view of an alternate embodiment of the present invention having a body that is configured to allow incorporation of the adjustable wrench into a common multifunction tool.
Figure 6:
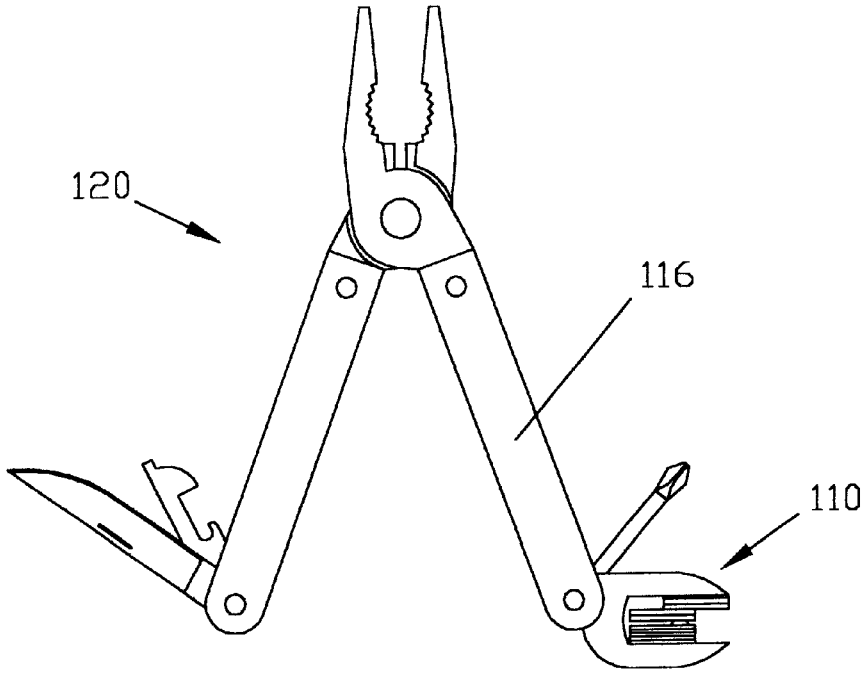
FIG. 6 shows the alternate embodiment of FIG. 5 incorporated as a foldout implement of a common multifunction tool.

FIGS. 5 and 6 illustrate an alternate embodiment of an adjustable wrench 110 according to the present invention wherein a body 112, having a hole 114, is sized and configured to allow the incorporation of the wrench into a handle 116 of a common multifunction tool 120 as a foldout implement. Other than the overall size of the wrench and its components, the elements are as stated with respect to the embodiment illustrated in FIGS. 1 through 4.

All of the components of the wrench are preferably made of steel or stainless steel, formed by conventional processes such as forging, casting, or machining. The components would, of course, receive conventional surface treatments such as nickel-chrome plating, black oxide coating, or passivation to enhance corrosion resistance and appearance.

OPERATIONAL DESCRIPTION

The dimensions given in the following discussion are for illustration purposes only and are not intended to limit the scope of the present invention. For the following example, the distance between planar surfaces 32 and 34 is 13-millimeter (mm). The thickness of each inch-increment shim is 1/16-inch. The thickness of each metric-increment shim is 1-mm. The thickness of the adapter shim is 0.012-inch (0.30-mm). All of the shims are initially located in shim-storage region 64.

To tighten a 10-mm hexagonal nut, the user rotates three metric-increment shims, 52*c*–52*e*, into fastener-receiving region 62. The three shims act to reduce the dimension of fastener-receiving region 62 from 13-mm to 10-mm. These three shims are functionally supported by planar surface 34 of second jaw member 24 during use. The other shims remain in shim-storage region 64. The wrench is now ready for use on the 10-mm nut in the conventional manner.

To tighten a 7/16-inch hexagonal nut, the user first rotates all of the metric-increment shims back into the shim-storage region. The user then rotates adapter shim 54 into fastener-receiving region 62 to convert the dimension of fastener-receiving region 62 from 13-mm to ½-inch. The user also rotates inch-increment shim 50*a* into fastener-receiving region 62 to reduce its width from ½-inch to 7/16-inch. These two shims are functionally supported by planar surface 32 of first jaw member 22 during use. The other shims remain in shim-storage region 64. The wrench is now ready for use on the 7/16-inch nut in the conventional manner.

The manipulation of the shims to select the proper size for the fastener-receiving region is quick, easy, and intuitive, since it is very similar to selecting a blade in a common folding pocketknife.

The shims are restrained from undesired movement by the biasing action of spring washer 70. This biasing action also keeps the shims in intimate contact with each other and keeps the shims pressed against the planar surfaces for functional support.

No additional actions, such as tightening a thumbscrew, are required of the user prior to using the wrench. Accordingly, the wrench can be used in any orientation, and subjected to numerous engagement-disengagement cycles in the course of tightening or loosening a nut, while precisely maintaining the user selected size of the fastener-receiving region. The continuous re-adjustment of the jaw spacing required in many prior art adjustable wrenches is not necessary. Furthermore, since the head of the wrench is of a minimum width and thickness, the present invention can be used effectively in tight spaces that would not accommodate adjustable wrenches of the prior art.

While the foregoing describes the preferred embodiment of the subject invention, it will be readily apparent to those skilled in the art that variations may be made without departing from the spirit of the invention or the scope of the following claims. The distance between planar surfaces 32 and 34 could be made larger or smaller than described previously. For example, a distance of 15-mm could be chosen. In this case, an adapter shim thickness of 0.028-inch (0.71-mm) could then be employed to convert the dimension of fastener-receiving region 62 from 15-mm to 9/16-inch. Further incremental reductions of fastener-receiving region 62, in either inch or metric units, would be made as previously discussed herein. Of course, a greater or lesser number of shims could be used to allow the wrench to accommodate any desired range of fastener sizes. It would also be within the scope of the present invention to create a double-ended version of the wrench with each end accommodating a specific range of sizes of both inch and metric unit fasteners.

We claim:

1. An adjustable wrench, comprising:

a) a body having at least one head portion, b) said head portion having an opening defined by at least a first jaw member, a second jaw member, and a connecting back portion, c) said first jaw member having a planar surface that is parallel to and spaced a predetermined distance from a corresponding planar surface on said second jaw member, d) a plurality of inch-increment shims of predetermined shape, length, width, and thickness, each having a hole near one end and an edge, e) a plurality of metric-increment shims of predetermined shape, length, width, and thickness, each having a hole near one end and an edge, f) an adapter shim of predetermined shape, length, width, and thickness, having a hole near one end and an edge, g) a pinning means to rotatably couple said inch-increment shims, said metric-increment shims, and said adapter shim to said first jaw member and said second jaw member, and h) said pinning means located such that said opening is divided into a shim-storage region and a fastener-receiving region, whereby a user may adapt the wrench for use on either English or metric unit fasteners by pivoting said adapter shim into either said shim-storage region or said fastener-receiving region and then incrementally vary the dimension of said fastener-receiving region by selectively pivoting the other shims into either said shim-storage region or said fastener-receiving region.

2. The adjustable wrench of claim 1, further including a spring means located between said inch-increment shims and said metric-increment shims, capable of applying continuous predetermined pressure on the shims, whereby the shims are restrained from undesired movement and are urged into intimate contact with each other and with said planar surfaces to provide functional support of the shims during use.

3. The adjustable wrench of claim 2, further including a locking means that acts upon the shims to hold the shims in either said shim-storage region or said fastener-receiving region of said opening.

4. The adjustable wrench of claim 3, wherein said locking means is a spring locking clip that is attached to said head portion and resiliently acts upon the edges of the shims.

5. The adjustable wrench of claim 1, further including a locking means that acts upon the shims to hold the shims in either said shim-storage region or said fastener-receiving region of said opening.

6. The adjustable wrench of claim 1, wherein said body further includes a hole allowing a pinning means to rotatably couple said adjustable wrench to a handle of a common multifunction tool, whereby said adjustable wrench can be incorporated as a foldout implement of said multifunction tool.

* * * * *